United States Patent [19]

Kobayashi

[11] 4,154,137

[45] May 15, 1979

[54] MUTE ASSEMBLY FOR DRUM-LIKE PERCUSSIVE MUSICAL INSTRUMENTS

[75] Inventor: Haruhiko Kobayashi, Hamamatsu, Japan

[73] Assignee: Nippon Gakki Seizo Kabushiki Kaisha, Japan

[21] Appl. No.: 777,480

[22] Filed: Mar. 14, 1977

[30] Foreign Application Priority Data

| | | | |
|---|---|---|---|
| Mar. 16, 1976 | [JP] | Japan | 51-31487[U] |
| Dec. 14, 1976 | [JP] | Japan | 51-149462 |
| Dec. 14, 1976 | [JP] | Japan | 51-166695[U] |

[51] Int. Cl.[2] ..... G10D 13/02

[52] U.S. Cl. ..... 84/411 R

[58] Field of Search ..... 84/411, 413, 419, 402, 84/418, 412, 414–417, 420

[56] References Cited

U.S. PATENT DOCUMENTS

| | | | |
|---|---|---|---|
| 1,579,893 | 4/1926 | Simpson | 84/411 |
| 2,495,451 | 1/1950 | Gladstone | 84/411 |
| 2,499,616 | 3/1950 | Walberg | 84/411 |

*Primary Examiner*—L. T. Hix
*Assistant Examiner*—Benjamin R. Fuller
*Attorney, Agent, or Firm*—Ostrolenk, Faber, Gerb & Soffen

[57] ABSTRACT

An elastically deformable mute element has a shape with which its surface area of contact is easily and appreciably changeable depending on the pressure when pressed against the head of percussive musical instrument for snugger and evener pressure contact with the head surface, the entire mute assembly being ideally arranged outside the instrument and the locus of movement of the mute element for the pressure contact being preferably substantially perpendicular to the head surface.

19 Claims, 10 Drawing Figures

MUTE ASSEMBLY FOR DRUM-LIKE PERCUSSIVE MUSICAL INSTRUMENTS

BACKGROUND OF THE INVENTION

The present invention relates to an improved mute assembly for percussive musical instruments, and more particularly relates to improvements in the shape of the mute element, the arrangement of the entire assembly and the movement of the entire assembly and the movement of the mute element for pressure contact with the head of the percussive instrument.

In the construction of percussive musical instruments such as drums, a batter head is disposed, in stretched state, to one open end of a cylindrical body to obtain tonal vibrations of prescribed pitchs when striken or battered, the head being in general made of animal skins or synthetic resinous films. The head is specially regarded as giving significant influence on the quality of tones generated by the percussive instruments. The percussive instrument of this type is in general accompanied with a mute assembly which adjusts the mechanical vibration of the head to change the quality of tones to be generated by the instument when battered.

One typical example of the conventional mute assembly includes a mute element given, in general, in the form of a flat pad made of felt or the like material and the mute element is adapted for pressure contact with the inner surface (undersurface) of the head. A spring member carrying the mute element at one end thereof is fixedly provided in the cavity of the instrument and repulsion of the spring member for causing the pressure contact is adjusted by turning a screw member operably related to the spring member. Being urged by the spring member, the mute element moves towards the head from its stand-by, i.e. the inoperative, position along a circular locus. Most parts of the mute assembly but the adjusting knob for the screw member are arranged within the cavity defined by the head and the body of the instrument.

The relatively thin flat shape of the conventional mute element tends to cause poor, biased and uneven contact of the mute element when pressed against the head surface, thereby lowering mute effect on the quality of tones. In order to obviate this lowering effect, the mute element may be presented against the heat at high contact pressure, i.e. with increased spring force. But, such extremely high pressure contact of the mute element with the head surface causes change in the stretch of the head itself and, accordingly, is apt to disorder the prescribed pitch of tonal vibrations.

The circular locus to be traced by the mute element moving towards the head further amplifies the above-described biased uneven contact of the mute element with the head surface as the locus crosses the head surface obliquely.

Use of the spring member which is generally made of a metallic material tends to cause resonant vibration of the spring member when the head is beaten, thereby generating undesirable noises during the play of the percussive instrument for which the above-described conventional mute assembly is used.

The most part of the conventional mute assembly are arranged within the cavity of the percussive instrument and, with this construction, the head of the instrument when striken is first deformed convex towards inside of the instrument and simultaneously pressed against the mute element. Then, the head is repulsively moved back towards the opposite direction departing from the mute element. So, the tonal vibrations generated by the striken head are enfeebled by the existence of the mute element from the start, and the mute effect is not effectively obtained when expected. In addition, presence of the entire mute assembly within the cavity of the instrument leads to relatively difficult access to them from outside thereby making attachment and detachment of the mute assembly to and from the instrument very complicated. When the head is beaten, the air prevailing in the cavity of the instrument vibrates accordingly and the cavity functions as a kind of resonator. Presence of the parts of the mute assembly within the resonant cavity hinders ideal resonant vibration of the air in the cavity. Further, such pneumatic vibrations cause corresponding vibrations of the mechanical parts of the assembly, thereby expediting undesirable loosening of such parts in the cavity.

OBJECTS OF THE INVENTION

It is the principal object of the present invention to provide a mute assembly for percussive musical instruments which assures snug and even pressure contact between the mute element and the head surface without any disorder to the prescribed pitch of tornal vibrations to be generated by the instrument.

It is another object of the present invention to provide a mute assembly in which the mute element comes into pressure contact with the head along a straight locus substantially perpendicular to the head surface.

It is the other object of the present invention to provide a mute assembly which is free from generation of undesirable noises during the play of the percussive instrument.

It is a further object of the present invention to provide a mute assembly which applies the mute effect to the tonal vibrations generated by the striken head at the most optimum timing.

It is a further object of the present invention to provide a mute assembly which can easily and simply attached and detached to and from percussive instruments.

It is a further object of the present invention to provide a mute assembly which eliminates any hindrance to the ideal vibration of the air in the resonant cavity of the instrument.

It is a further object of the present invention to provide a mute assembly which is free from early loosening of its mechanical parts to be caused by the pneumatic vibration in the resonant cavity of the instrument.

SUMMARY OF THE INVENTION

In accordance with the basic aspect of the present invention, the mute element is made of an elastically deformable material such as felt, urethane rubber and foamed/resin and has a shape easily causative of appreciable change in the surface area of contact in accordance with the magnitude of contact pressure at which the mute element is pressed against something else. The mute element is so disposed to a percussive musical instrument that, in the operative disposition, same is pressed against the head of the instrument whereas, in the inoperative disposition, same is kept confronting the head.

In a preferred embodiment of the present invention, the direction of displacement of the mute element towards the head surface is substantially perpendicular to the head surface.

In a further preferred embodiment of the present invention, the mute element confronts and comes into the pressure contact with the inner surface of the head of the instrument.

In a further preferred embodiment of the present invention, the mute element confronts and comes into the pressure contact with the outer surface of the head of the instrument.

DETAILED DESCRIPTION OF THE INVENTION

Figure 1:
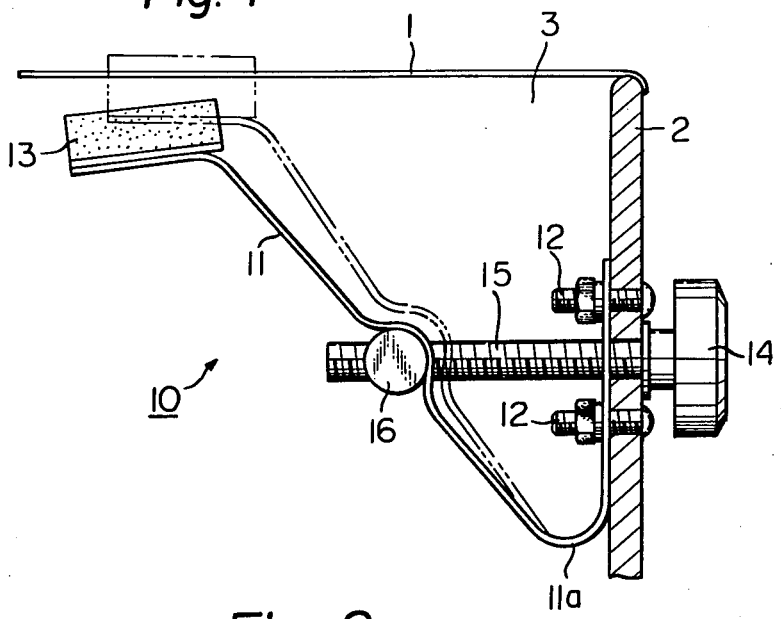
Fig. 1 PRIOR ART
FIG. 1 is a side view, partly in section, of the conventional mute assembly.

One example of the conventional mute assembly is shown in FIG. 1, in which major parts of the mute assembly 10 is contained in the cavity 3 defined by the batter head or vibratory tone producing member 1 and hollow body 2 of the drum, the cavity 3 forming a kind of resonator. An L-shaped spring arm 11 is fixed at one end thereof to the inside surface of the body 2 via set screws 12 and is provided, at the free end thereof, with a mute element 13 such as a felt pad. An adjusting knob 14 located outside the body 2 has an outwardly threaded extension 15 screwed through the body 2 and extending into the cavity 3. A horizontal bar 16 is screwed over the threaded extension 15 within the cavity 3 and the spring arm 11 pressuredly bears on the horizontal bar 16 about at the midway of its length. When the knob 14 is turned, the horizontal bar 16 moves in the axial direction of the extension 15 but does not turn about the axis of the bar 16 due to the pressure applied by the spring arm 11.

In order to set the mute assembly 10 into the operative disposition, the adjusting knob 14 is so turned that the horizontal bar 16 moves towards the fixed end of the spring arm 11 and, accordingly, the free end of the spring arm 11 swings upwardly overcoming the repulsion of the spring arm 11. Thus, the mute element 13 assumes the position shown with chain lines in the drawing while being brought into pressure contact with the undersurface (inner surface) of the head 1.

In order to reset the mute assembly 10 into the inoperative disposition, the adjusting knob 14 is so turned that the horizontal bar 16 moves along the extension 15 away from the fixed end of the spring arm 11 and, accordingly, the free end of the spring arm 11 swings downwardly due to the repulsion of the spring arm 11, thereby liberating the mute element 13 from contact with the undersurface (inner surface) of the head 1.

As the spring arm 11 swings due to turning of the adjusting knob 14, the mute element 13 moves along an approximately circular locus whose center falls approximately on the bent bottom portion 11*a* of the spring arm 11 and, with the construction of the conventional mute assembly, more particularly with that of the conventional mute element, the circularity of the locus seriously hinders the mute element from coming into snug and even contact with the undersurface (inner surface) of the head 1.

Figure 2:
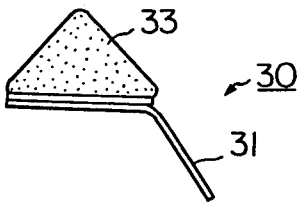
FIG. 2 is a fragmentary side view of an embodiment of the mute assembly of the present invention.

One embodiment of the mute assembly in accordance with the present invention is shown in FIG. 2, in which the mute assembly 30 is provided, at the free end of the spring arm 31, with a mute element 33 conicallyconverging towards the free end thereof, the free end being adapted for contact with the undersurface (inner surface) of the head 1. The arrangement of the remaining parts of the mute assembly is substantially same as that of the mute assembly shown in FIG. 1.

The mute element 33 is made up of an elastically deformable material such as felt, urethane rubber and foamed resin, and is provided with a shape for easily causing appreciable change in the surface area of contact in accordance with the magnitude of the contact pressure at which the mute element 33 is pressed against something else, e.g. the head 1. That is, the mute element 33 of the present invention has the surface area of contact more enlarged in accordance with the increased magnitude of the contact pressure. As in the case of the embodiment shown in FIG. 2, the mute element 33 in accordance with the present invention is advantageously provided with a shape converging towards the end thereof adapted for contact with the head 1.

Figure 3A:
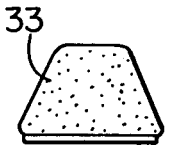
FIGS. 3A through 3C are elevational side views of various embodiments of the mute element usable for the present invention.
Figure 3B:
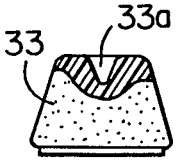
Figure 3C:
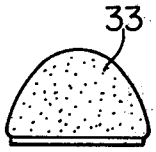

The mute element 33 shown in FIG. 3A is provided with a frusto-conical shape, the mute element 33 shown in FIG. 3B is a variant of the one in FIG. 3A in which a center hollow 33*a* is formed in the free end and the mute element 33 shown in FIG. 3C is provided with a semi-spherical shape. It should be understood that various modifications may be derived from the illustrated examples.

Thanks to the elastically deformable nature of the material and the specially designed shape, the mute element 33 in accordance with the present invention can well attain snug and even contact with the undersurface (inner surface) of the head when pressed against the head by turning of the adjusting knob 14 despite of the circular locus thereof at swinging of the spring arm 31.

Figure 4:
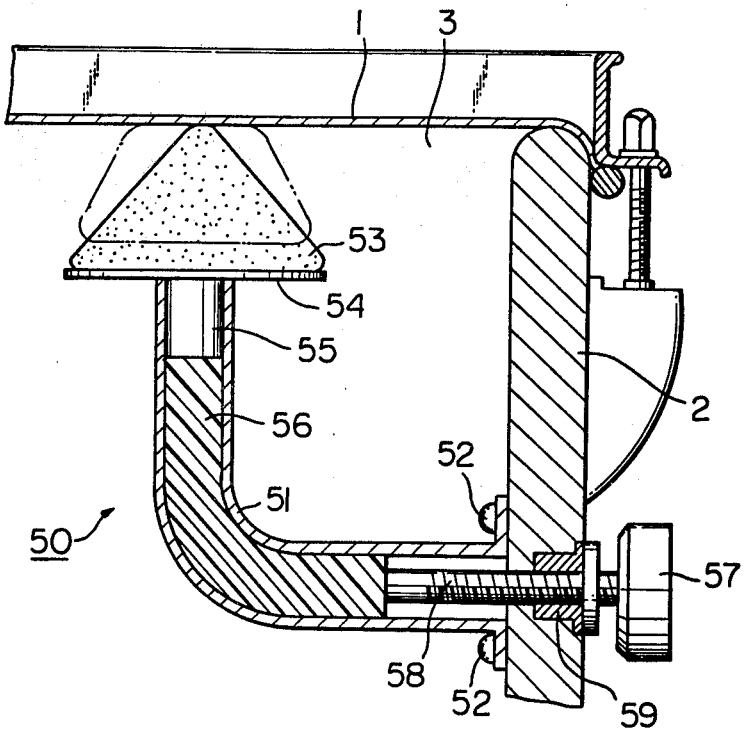
FIG. 4 is a side view, partly in section, of another embodiment of the mute assembly of the present invention.
Figure 5:
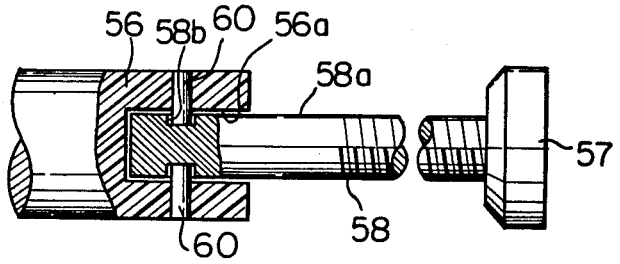
FIG. 5 is an elevational side view, partly in section, of a connecting mechanism usable for the mute assembly shown in FIG. 4.

The mute assembly 30 shown in FIG. 2 is further improved in the embodiment shown in FIGS. 4 and 5, in which the moving locus of the mute element towards and away from the undersurface (inner surface) of the head 1 is designed substantially perpendicular to the undersurface (inner surface) of the head 1. The mute assembly 50 in FIG. 4 includes an L-shaped elongated guide pipe 51 fixed at one open end thereof to the inside surface of the hollow body 2 via set screws 52. The other open end of the elongated guide pipe 51 spacedly confronts the undersurface (inner surface) of the head 1 with the axis thereof being substantially perpendicular to the undersurface (inner surface). A mute element 53 is fixed on a base plate 54 having a bottom extension 55 slidably inserted into the free end opening of the pipe 51. As in the foregoing embodiment, the mute element 53 is made of an elastically deformable material such as felt, urethane rubber and foamed resin, and is provided with a shape for easily causing appreciable change in the surface area of contact in accordance with the magnitude of the contact pressure at which same is pressed against something else, e.g. the head 1. A conical shape is employed in the illustrated embodiment. A rod-shaped elastic member 56 is inserted into the guide pipe 51 in an axially slidable disposition with one end thereof fixed to the bottom extension 55. As is clear from the drawing, the total length of the elastic member 56 is smaller than that of the guide pipe 51. An adjusting knob 57 located outside the body 2 has an partly, outwardly threaded extension 58 screwed through a bushing 59 embedded in the body 2 and extending into the guide pipe 51. The inner end of the extension 58 is connected to the other end of the elastic member 56 in the guide pipe 51.

One embodiment of the connection between the threaded extension 58 with the elastic member 56 is shown in FIG. 5, in which the threaded extension 58 is provided, at the flat portion 58*a* thereof inserted into the axial hole 56*a* of the elastic member 56, with an annular groove 58*b* into which a pair of pins 60 engage, the pins 60 being radially fixed to the elastic member 56 and projecting somewhat into the axial hole 56*a*. Thanks to this connection, the elastic member 56 does not follow axial turning of the extension 58 but follow axial movement of the extension 58. It should be understood that any other type of connection can be employed in the present invention so far as the connection allows axial sliding of the elastic member 56 but restricts axial turning of same as the extension 58 turns.

In order to set the mute assembly 50 into the operative disposition, the operating knob 57 is so turned that the extension 58 advances into the guide pipe 51. Then, the mute element 53 is pushed towards the head 1 via the elastic member 56, the bottom extension 55 and the base plate 54 to assume the disposition shown with chain lines in the drawing while being brought into pressure contact with the undersurface (inner surface) of the head 1. In this disposition, the mute element 53 is deformed in shape and increases its surface area of contact with the head 1 thanks to its elastically deformable nature, i.e. the material and the shape.

In order to reset the mute assembly 50 into the inoperative disposition, the adjusting knob 57 is so turned that extension 58 recedes out of the guide pipe 51 while pulling the elastic member 56 towards the fixed end of the guide pipe 51. This movement of the elastic member 56 causes corresponding recession of its one end, on the free end side of the guide pipe 51, within the guide pipe 51, and the mute element 53 and its related parts are pulled downwards away from the head 1. Thus, being liberated from the pressure contact with the undersurface (inner surface) of the head 1, the mute element 53 resumes its original shape shown with solid lines in the drawing.

In addition to the effect resulted from the specially designed shape of the mute element 53, the moving locus of the mute element 53 is substantially straight and perpendicular to the undersurface (inner surface) of the head 1 in the case of the present embodiment. This combined effects assure further enriched snug and evener contact of the mute element with the undersurface (inner surface) of the head 1. The easily deformable nature of the mute element 53 to be resulted from the material and shape thereof causes increased surface area of contact of the mute element 53 with the undersurface (inner surface) of the head 1, thereby evening the pressure contact between the two bodies. Slight turning of the adjusting knob 57 develops corresponding slight change in the surface area of contact between the two bodies, thereby enabling delicate adjustment of the mute effect. In addition, the swingable spring arm 11 used in the foregoing embodiment for urging the mute element into pressure contact with the head 1 is omitted in the present embodiment and the elastic member 56 is substituted therefor. Under normal conditions, the elastic member 56 is by far less responsive to the vibration of the beaten head 1 than the swingable spring arm 11. In other words, vibrations of the head 1 when beaten accompanies substantially no resonant vibration of the elastic member 56. So, generation of undesirable noises by resonant vibration of the urging means for the mute element can considerably be slashed.

Figure 6:
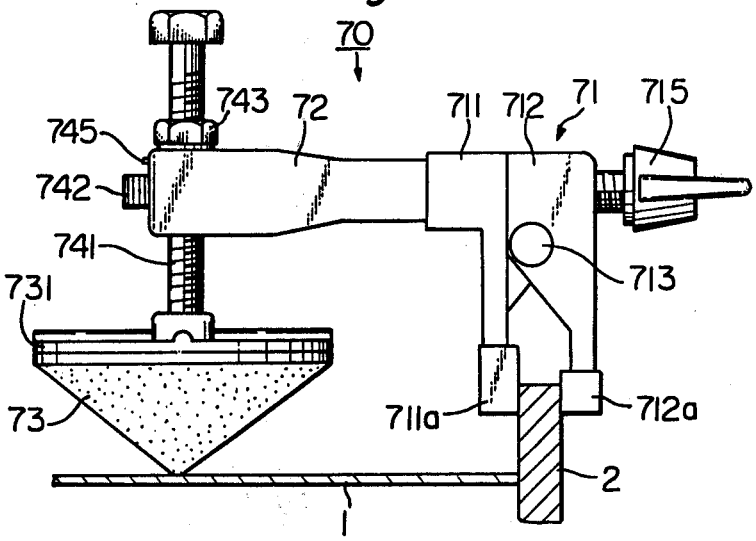
FIG. 6 is a side view of the other embodiment of the mute assembly of the present invention.
Figure 7:
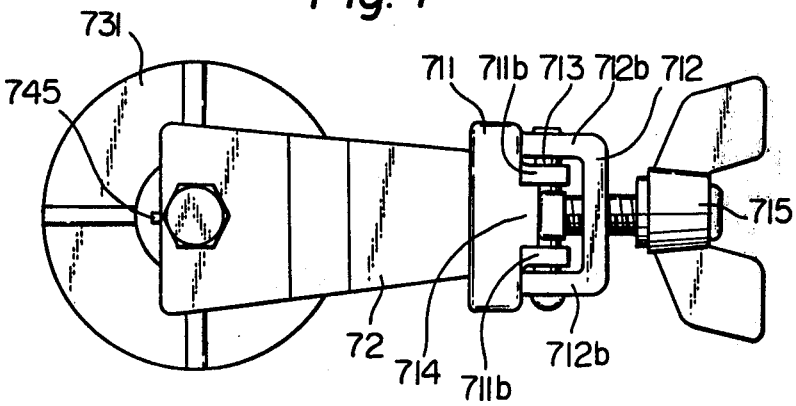
FIG. 7 is a top view of the mute assembly shown in FIG. 6.
Figure 8:
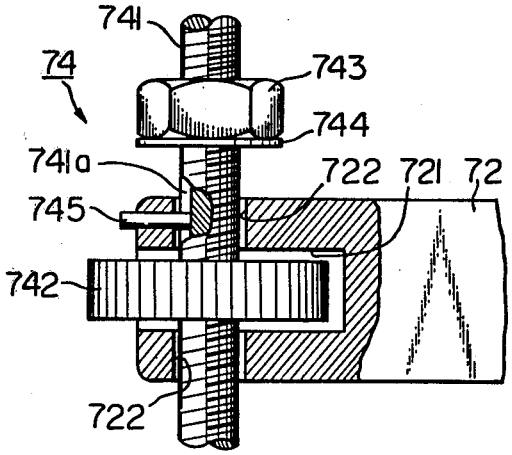
FIG. 8 is an elevational side view, partly in section of the urging mechanism used for the mute assembly shown in FIGS. 6 and 7.

The mute assembly 50 shown in FIGS. 4 and 5 is further improved in the embodiment shown in FIGS. 6 through 8, in which the entire mute assembly is located outside of the instrument, i.e. outside of the cavity 3 defined by the head 1 and the body 2. The mute assembly 70 of this embodiment includes a mounting mechanism 71 detachably mounted to the body 2 of the instrument, a holding arm 72 carried by the mounting mechanism 71 and extending along the top surface (outer surface) of the head 1 being upwardly spaced therefrom, an urging mechanism 74 disposed to the free end of the holding arm 72 and carrying a mute element 73 with the free end of the mute element 73 confronting the top surface (outer surface) of the head 1.

The mounting mechanism 71 includes a pair of clamping arms 711 and 712 pivotally coupled to each other by a horizontal pin 713. The clamping arms 711 and 712 are both provided, at the lower ends thereof, with clamping ends 711*a* and 712*a* adapted for clamping the upper fringe of the body 2 of the instrument. The pin 713 extends idlly through paired branches 711*b* of the clamping arm 711 and paired branches 712*b* of the clamping arm 712. A seat 714 is formed on the outer side surface of the clamping arm 711 at a position between the pair of branches 711*b*. An outwardly threaded wing nut 715 is screwed through the portion of the clamping arm 712 for connecting the paired branches 712*b* and the free end thereof is in abutment with the seat 714 formed on the clamping arm 711. Thus, when the wind nut 715 is turned in one direction, the clamping arms 711 and 712 so swing about the pin 713 that the clamping ends 711*a* and 712*a* firmly clamp the upper fringe of the body 2. When the wing nut 715 is turned in the other direction, the clamping arms 711 and 712 so swing about the pin 713 that the clamping of the upper fringe of the body 2 by the clamping ends 711*a* and 712*a* is cancelled.

The holding arm 72 is fixed to the inner side surface of the clamping arm 711 and extends along the top surface (outer surface) of the head 1 while being upwardly spaced therefrom. This holding arm 72 is provided with a relatively flat longitudinal recess 721 opening in the free end thereof and a through hole 722 formed substantially perpendicularly to the longitudinal direction of the holding arm 72. Naturally, the through hole 722 opens in the longitudinal recess 721. (see FIG. 8).

The detailed construction of the urging mechanism 74 is shown in FIGS. 6 and 8, in which the urging mechanism 74 includes an outwardly threaded bolt 741 idlly inserted through the through hole 722 formed in the holding arm 72, an adjusting dial 742 screwed over the bolt 741 within the longitudinal recess 721 of the holding arm 72 and a fastening nut 743, with a washer 744, screwed over the bolt 741 at a position outside the holding arm 72. The bolt 741 is provided with a longitudinal slot 741*a* formed in the peripheral surface thereof. A pin 745 is fixed to the holding arm 72 with the inner point thereof being exposed in the through hole 722 in slidable engagement with the slot 741*a* of the bolt 741. Due to the locking function of this pin 745, the bolt 741 is not axially turnable but movable in the axial direction thereof. The periphery of the adjusting dial 742 is partly exposed out of the recess 722 for manual turning thereof.

The mute element 73 is fixed to the bottom end of the bolt 741 via a base plate 731 with the free end thereof confronting the top surface (outer surface) of the head 1 of the instrument. Like in the previous embodiments, the mute element 73 is made up of an elastically deformable material such as felt, urethane rubber and foamed resin, and is provided with a shape for easily causing appreciable change in the surface area of contact in accordance with the magnitude of the contact pressure at which the mute element 73 is pressed against something else, e.g. the head 1.

In order to set mute assembly 70 into the operative disposition after mounting to the instrument, the adjusting dial 742 is so turned that the bolt 741 moves downwardly towards the head 1 of the instrument to push the mute element 73 against the top surface (outer surface) of the head 1 and the mute element 73 is deformed, thereby increasing the surface area of contact between the two bodies. After the setting is complete, the position of the bolt 741 is set by fastening the nut 743.

In order to reset the mute assembly 70 into the inoperative disposition, the adjusting dial 743 is so turned that the bolt 741 moves upwardly away from the head 1 to recede the mute element 73 from contact with the top surface (outer surface) of the head 1. After the resetting is complete, the mute element 73 is liberated from the contact pressure and instantly resumes its original shape.

In accordance with the above-described embodiment of the present invention, the mute assembly is easily detachably mounted to the instrument via the clamping system. This enables easy detachment of the mute assembly from the instrument for conveniency in transporation of the instrument. In addition, the disposition of the entire mute assembly outside the instrument leads to several advantageous merits. In the first place, easy access to the mute assembly assures easy and simple mounting and dismounting of same to and from the instrument. Secondly, as the mute element is arranged for pressure contact with the top (outer) surface of the head in accordance with the present embodiment, the head comes into pressure contact with the mute element after it has repulsively recovered from the inwardly convex state caused by striking. Thus, the tonal vibration is effectively attained without being obstructed by the existence of the mute element, and thereafter the resultant mute effect is by far escalated when compared with the mute assembly located within the cavity of the instrument in which the head comes into pressure contact with mute element while being in the inwardly convex state caused by striking. Thirdly, as the entire mute assembly is located fully outside the instrument, there is nothing within the cavity of the instrument which is obstructive of ideally resonative vibration of the air in the cavity. Fourthly, the parts of the mute assembly are quite free from unfavorable loosening to be caused by the pneumatic vibration within the cavity of the instrument when beaten.

I claim:

1. An improved mute assembly for a percussion musical instrument, said instrument having a vibratory tone producing member, said mute assembly comprising a mute element having a contact surface for contacting said vibratory tone producing member, said mute element being made of an elastically deformable material having a portion thereof with a shape converging toward said contact surface, such that the contact area easily appreciably changes in the surface area of its contact surface on said vibratory tone producing member in accordance with and corresponding to the magnitude of contact pressure at which said mute element is pressed against said vibratory tone producing member; means for disposing said mute element to said percussive musical instrument in such an arrangement that, in the operative disposition, said mute element is flattened as it is pressed against said vibratory tone producing member so as to provide a snug and even contact.

2. The improved mute assembly as claimed in claim 1 in which said mute element is made of a material chosen from a group composed of felt, urethane rubber and foamed resin.

3. The improved mute assembly as claimed in claim 1 in which said mute element is substantially conical in shape.

4. The improved mute assembly as claimed in claim 1 in which said mute element is substantially frusto-conical in shape.

5. The improved mute assembly as claimed in claim 1 in which said mute element is substantially semi-spherical in shape.

6. The improved mute assembly as claimed in claim 1 in which said mute element is provided with at least one recess formed in said free end.

7. The improved mute assembly as claimed in claim 1 in which said disposing means includes;

means for holding said mute element in an arrangement displaceable towards said vibratory tone producing member;

means disposed to said holding means and for causing the displacement of said mute element to bring said contact surface into prescribed pressure contact with said vibratory tone producing member; and means for detachably mounting said holding means to the body of said percussive musical instrument.

8. The improved mute assembly as claimed in claim 7 in which said holding means includes an L-shaped spring arm fixed, at one end thereof, to said body and carrying, at the other end thereof, said mute element; and said causing means includes an outwardly threaded extension of an adjusting knob disposed through said body and a bar on which said spring arm bears under pressure.

9. The improved mute assembly as claimed in claim 8 in which said vibratory tone producing member has an inner surface inside said percussion instrument and an outer surface outside said instrument; said mute element contact surface confronts said inner surface of said vibratory tone producing member.

10. The mute assembly as claimed in claim 8 in which said vibratory tone producing member has an inner surface inside said percussion instrument and an outer surface outside said instrument; said mute element contact surface confronts said outer surface of said vibratory tone producing member.

11. The improved mute assembly as claimed claim 1 in which said disposing means includes;

means for holding said mute element in an arrangement displaceable towards said vibratory tone producing member with direction of displacement being substantially perpendicular to said vibratory tone producing member, means disposed to said holding means and for causing said displacement of said mute element to bring said contact surface into prescribed pressure contact with said vibratory tone producing member; and means for detachably mounting said holding means to the body of said percussive instrument.

12. The improved mute assembly as claimed in claim 11 in which said vibratory tone producing member has an inner surface inside said percussion instrument and an outer surface outside said instrument; said mute element contact surface confronts said inner surface of said vibratory tone producing member.

13. The improved mute assembly as claimed in claim 12 in which said holding means includes an L-shaped elongated, open guide pipe fixed, at one open end thereof, to the inside surface of said body and being spaced from and confronting, at the other open end thereof, the inner surface of said vibratory tone producing member with the axis of said pipe being substantially perpendicular to said inner surface, said mute element resting on said other open end of said guide pipe; and said causing means includes an elastic member slidably inserted into said guide pipe with one end thereof operably related to said mute element, an adjusting knob located outside said body, a partially externally threaded extension of said adjusting knob screwed through said body and extending into said one open end of said guide pipe, and means for connecting the other end of said elastic member to the inner end of said extension in such a manner as to allow axial movement of said elastic member in said guide pipe only.

14. The improved mute assembly as claimed in claim 13 in which said connecting means includes the flat end portion of said extension of said adjusting knob provided with an annular groove, said other end of said elastic member provided with an axial hole receiving said flat end portion of said extension and at least one radial pin fixed to said other end of said elastic member and engaging said annular groove of said extension.

15. The improved mute assembly as claimed in claim 11 in which said vibratory tone producing member has an inner surface inside said percussion instrument and an outer surface outside said instrument; said mute element contact surface confronts said outer surface of said vibratory tone producing member.

16. The improved mute assembly as claimed in claim 15 in which said holding means includes a holding arm carried by said mounting means and extending along said outer surface of said vibratory tone producing member, and being spaced therefrom; and causing means including an urging mechanism partly incorporated in a longitudinal recess formed in said holding arm and including an outwardly threaded bolt carrying, at one end thereof, said mute element, the axis of said bolt being substantially perpendicular to said outer surface of said vibratory tone producing member.

17. The improved mute assembly as claimed in claim 16 in which said urging mechanism includes said outwardly threaded bolt idlly extending through said holding arm substantially perpendicularly across said longitudinal recess, an adjusting dial screwed over said bolt in said longitudinal recess with its periphery being partly exposed outside said holding arm, and a stopper pin fixed to said holding arm with its point engaging with a longitudinal slot formed in the periphery of said bolt.

18. The improved mute assembly as claimed in claim 15 in which said mounting means includes a pair of clamping arms pivoted to each other and each having a clamping end adapted for clamping the fringe of said body, and a wing nut screwed through one of said clamping arm and abuts, at the inner end thereof, the other of said clamping arm in such an arrangement that twining of said wing nut causes corresponding swinging of said clamping arms about the pivotal point.

19. The improved mute assembly as claimed in claim 1 in which said vibratory tone producing member has an inner surface inside said percussion instrument and an outer surface outside said instrument; said mute element contact surface confronts said outer surface of said vibratory tone producing member.

* * * * *